US007223708B2

(12) United States Patent
Beuzieron

(10) Patent No.: US 7,223,708 B2
(45) Date of Patent: May 29, 2007

(54) INORGANIC FABRIC

(76) Inventor: Lilo Nessim Beuzieron, 11255 Kling St., West Toluca Lake, CA (US) 91602

( * ) Notice: Subject to any disclaimer, the term of this patent is extended or adjusted under 35 U.S.C. 154(b) by 223 days.

(21) Appl. No.: 11/144,360

(22) Filed: Jun. 3, 2005

(65) Prior Publication Data

US 2006/0276090 A1 Dec. 7, 2006

(51) Int. Cl.
*B32B 5/02* (2006.01)

(52) U.S. Cl. ..... 442/172

(58) Field of Classification Search ..... 442/172–180
See application file for complete search history.

(56) References Cited

U.S. PATENT DOCUMENTS 4,673,697 A * 6/1987 Rowley ..... 523/218
5,925,221 A * 7/1999 Sayers et al. ..... 162/348
6,647,747 B1 * 11/2003 Brik ..... 65/492
2004/0115439 A1 * 6/2004 Degroote ..... 428/423.1
2006/0273484 A1 * 12/2006 Beuzieron ..... 264/103

* cited by examiner

*Primary Examiner*—Elizabeth M. Cole
*Assistant Examiner*—Matthew D. Matzek
(74) *Attorney, Agent, or Firm*—Nydegger & Associates

(57) ABSTRACT

A fabric is formed from yarn comprised of inorganic filaments coated with rayon. Specifically, the inorganic filaments are spun from a melt of volcanic black rock and are comprised of calcium oxide, magnesium oxide, potassium oxide, aluminum oxide, iron oxide, silicon dioxide, titanium dioxide, sodium oxide, and boron. As a result of its composition, the fabric is temperature resistant and lightweight, yet strong. Preferably, the fabric exhibits a melting point between 1500° C. and 1650° C., a working range of −130° C. to 700° C., a density of 1.6 g/cc, a surface density between 160 g/m$^2$ and 350 g/m$^2$, and a tensile strength between 500 lbf/in$^2$ and 1800 lbf/in$^2$.

20 Claims, 1 Drawing Sheet

INORGANIC FABRIC

FIELD OF THE INVENTION

The present invention pertains generally to fabrics formed from yarn. More particularly, the present invention pertains to high performance fabrics formed from yarns comprised of inorganic filaments. The present invention is particularly, but not exclusively, useful for creating a fabric from yarn derived from inorganic raw materials including black rock.

BACKGROUND OF THE INVENTION

Conventional fabrics are typically produced from organic or synthetic polymeric fibers. Due to their composition, these fabrics have very limited use at high temperatures and under conditions where force resistance is required. Specifically, such fabrics rapidly deteriorate when subjected to high temperatures, and they typically have limited strength under most conditions.

Increasingly, fabrics are being formed from high performance yarns rather than conventional yarns. High performance yarns have both increased strength and an increased elastic modulus compared to conventional yarns. Typically, the high performance yarns are formed from inorganic filaments. The use of these filaments has resulted in a new family of yarns and fabrics that have high tensile strengths and moduli, and they have the ability to maintain these properties at elevated temperatures. Nevertheless, the strength and heat resistance of fabrics formed from known inorganic filaments can be improved upon.

To improve upon the strength and heat resistance of known fabrics, the present invention utilizes unrefined raw materials, such as volcanic rock, to manufacture inorganic filaments that can be woven into fabric. Inorganic filaments manufactured from volcanic rock have been found to exhibit excellent strength and heat resistance qualities. Likewise, fabrics woven or otherwise formed from these inorganic filaments also exhibit these same excellent strength and heat resistance qualities.

In light of the above, it is an object of the present invention to provide a fabric formed from inorganic yarn. Another object of the present invention is to provide a fabric formed from an organic yarn derived from volcanic rock. It is yet another object of the present invention to provide a fabric formed from a yarn comprising inorganic filaments coated with rayon. Still another object of the present invention is to provide high strength, heat resistant fabrics that are relatively easy to manufacture, simple to use and comparatively cost effective.

SUMMARY OF THE INVENTION

The present invention is directed to a fabric formed from yarn comprised of inorganic filaments formed from a volcanic rock and coated with rayon. Specifically, the inorganic filaments are spun from a melt of the volcanic rock. Preferably, the volcanic rock is black rock that contains aluminum oxide, iron oxide, silicon dioxide, titanium dioxide, magnesium oxide, calcium oxide, sodium oxide, and potassium oxide. In addition to the black rock, the melt includes an additive that preferably comprises iron oxide, whitestone and boron.

After the filaments are spun from the melt, they are sized or coated with a rayon sizing agent. The sized filaments are then twisted together to form the yarn in a manner that is well understood in the art. Preferably, the resulting yarn has a diameter in a range of ten to fifteen millimeters and is approximately 98 wt. % inorganic filaments and 2 wt. % rayon.

While volcanic black rock is formed by a range of components, it is preferred that the manufacturing process is controlled so that the yarn is comprised of approximately 35–45 wt. % calcium oxide, 30–40 wt. % magnesium oxide, 5–10 wt. % potassium oxide, less than 2 wt. % aluminum oxide, 5–10 wt. % iron oxide, less than 2 wt. % silicon dioxide, less than 2 wt. % titanium dioxide, less than 2 wt. % sodium oxide, less than 2 wt. % boron, and 1–5 wt. % rayon. More preferably, the yarn is comprised of approximately 40 wt. % calcium oxide, 36.6 wt. % magnesium oxide, 8.4 wt. % potassium oxide, 0.8 wt. % aluminum oxide, 8.85 wt. % iron oxide, 0.85 wt. % silicon dioxide, 0.8 wt. % titanium dioxide, 0.8 wt. % sodium oxide, 0.6 wt. % boron, and 2 wt. % rayon.

As a result of its composition, the fabric of the present invention has a melting point between approximately fifteen hundred degrees Centigrade (1500° C.) and approximately sixteen hundred and fifty degrees Centigrade (1650° C.). Further, the fabric has a working range of approximately negative one hundred thirty degrees Centigrade (−130° C.) to approximately seven hundred degrees Centigrade (700° C.).

In addition to its excellent thermal characteristics, the fabric of the present invention exhibits superior strength and has good ballistic properties. Specifically, it has a tensile strength between approximately five hundred pound-force per square inch (500 $lbf/in^2$) and approximately eighteen hundred pound-force per square inch (1800 $lbf/in^2$). Further, the fabric has a surface density between approximately one hundred and sixty grams per square meter (160 $g/m^2$) and approximately three hundred and fifty grams per square meter (350 $g/m^2$). Also, the fabric is relatively very lightweight, with a density of about one and six tenths grams per cubic centimeter (1.6 g/cc).

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
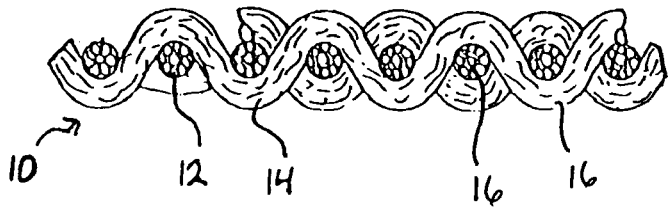
FIG. 1 is an enlarged, diagrammatic side view of a fabric in accordance with an embodiment of the present invention.

Referring to FIG. 1, a high strength, heat resistant fabric in accordance with the present invention is shown and generally designated 10. As shown, the fabric 10 is comprised of a plurality of fill yarns 12 arranged substantially parallel to one another. Further, a plurality of warp yarns 14 are woven with the fill yarns 12 in a serpentine fashion (i.e., over and under adjacent fill yarns 12). For the present invention, both the fill yarns 12 and warp yarns 14 are comprised of a yarn 16 formed from inorganic volcanic rock, additives and rayon. As a result, the fabric 10 consists solely of the inorganic yarn 16 and exhibits certain desired characteristics discussed below.

Figure 2:
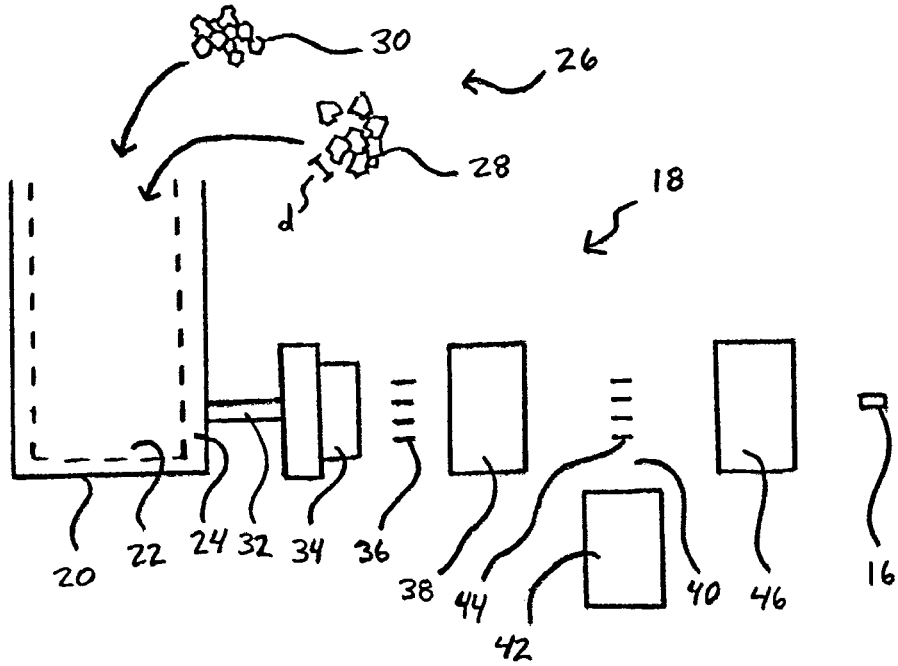
FIG. 2 is a schematic diagram exemplifying a method for manufacturing inorganic yarn in accordance with the present invention.
Figure 2:
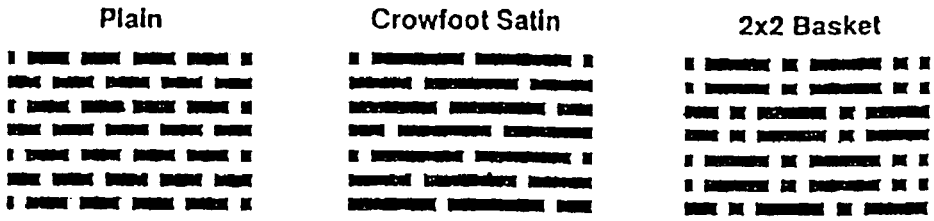

Referring now to FIG. 2, a system 18 for manufacturing the inorganic yarn 16 is depicted. As shown, the system 18 includes a furnace 20. The furnace 20 is preferably a cupola furnace and includes a chamber 22 formed by a sidewall 24. The chamber 22 is dimensioned to receive the raw materials 26 needed to manufacture the inorganic yarn. Specifically, the raw materials 26 include black rock 28 and an additive 30. As indicated, the black rock 28 and additive 30 are provided to the chamber 22 in the form of crushed solids. Once they are received in the chamber 22, they are liquefied therein to form a melt 32.

Downstream of the furnace 20, the system 18 includes a spinning device 34. The spinning device 34 may be integral with the furnace 20 or it may be connected directly to the furnace 20 for receiving the melt 32. Alternatively, the melt 32 may be delivered to the spinning device 34 via a carrier such as a ladle or the like. In either case, the spinning device 34 includes a pump or other means to force the melt 32 though an aperture, or several apertures, to form a plurality of filaments 36. Preferably, the apertures of the spinning device 34 are formed by a stationary platinum nozzle that can withstand the high temperatures of the melt 32.

As shown in FIG. 2, the system 18 further includes a cooling device 38 that is positioned downstream of the spinning device 34. Similar to the spinning device 34, the cooling device 38 may be integral with the furnace 20 or it may be connected thereto. As shown, the cooling device 38 is positioned to receive the plurality of filaments 36 from the spinning device 34. Further, a sizing station 40 is positioned downstream of the cooling device 38 to receive the plurality of filaments 36 therefrom. The sizing station 40 includes a sizing agent 42 that can be applied to the plurality of filaments 36 to form a plurality of fibers 44. As is further shown in FIG. 2, a twisting device 46 is positioned immediately downstream of the sizing station 40. The twisting device 46 receives the plurality of fibers 44 and forms the inorganic yarn 16 therefrom.

In more detail, the black rock 28 of the present invention is preferably of the type of volcanic rock that is commonly found in Oregon, Washington and other locations. Such black rock 28 typically contains about 44 wt. % calcium oxide, 41 wt. % magnesium oxide, 10 wt. % potassium oxide, 1 wt. % aluminum oxide, 1 wt. % iron oxide, 1 wt. % silicon dioxide, 1 wt. % titanium dioxide, and 1 wt. % sodium oxide. Unless treated or mixed with other materials, the black rock 28 typically has a melting point of over twelve hundred degrees Centigrade (1200° C.). Before it is introduced to the chamber 22 of the furnace 20, the black rock 28 is graded to individual pieces having diameters "d" of about 4–8 inches. Preferably, the individual pieces of black rock 28 all have substantially the same diameter "d".

As further shown in FIG. 2, the additive 30 is provided in the form of crushed solids. The additive 30 preferably has a melting point of about 900° C. and includes about 26–33 wt. % potassium permanganate, 39–45 wt. % iron oxide, 22–31 wt. % whitestone and 3 wt. % boron. For the invention, the potassium permanganate is provided as a fuel source for melting the raw materials 26 and the iron oxide is provided to modify the black rock 28. Further, the boron and whitestone, which contains about 58 wt. % calcium oxide, 41 wt. % magnesium oxide, less than 1 wt. % silicon oxide, and less than 1 wt. % iron oxide, are provided to reduce the melting point and facilitate processing of the mixture of raw materials 26.

As a batch process, a desired amount of black rock 28 and additive 30 are delivered to the furnace 20. Preferably, the raw material 26 provided to the chamber 22 consists essentially of 60–90 wt. % black rock 28 and 40–10 wt. % additive 30. In certain preferred embodiments, the raw material 26 consists essentially of 87–88% black rock 28 and 13–12% additive 30. In such an embodiment, the mixture of raw material 26 includes about 5–6 wt. % potassium permanganate, 4–6 wt. % whitestone, 8 wt. % iron oxide, and 0.6 wt. % boron. Volumetrically, the raw material 26 is preferably about one hundred parts of black rock 28 and about fourteen parts of additive 30.

When positioned in the chamber 22 of the furnace 20, the mixture of raw materials 26 is heated to a temperature in the range of approximately 955° C.–1270° C., and preferably to between 1200° C. and 1270° C. Regardless of the specific temperature attained, the mixture of raw materials 26 is heated sufficiently to reduce the raw materials 26 to liquefy to a melt 32 having a viscosity proper for processing. During heating, the potassium permanganate is burned as a fuel and facilitates liquefying the other raw materials 26.

After the melt 32 is properly formed, it is delivered to the spinning device 34. The spinning device 34 extrudes the melt 32 into a plurality of filaments 36 by forcing the melt 32 through its nozzle. The resulting filaments 36 have diameters substantially in a range between one and ten microns. In order to prevent deformation of the filaments 36, they are delivered to the cooling device 38 to be cooled and hardened to a soft solid state. During the cooling process, the cooling device 30 first cools the plurality of filaments 36 to 800° C. and maintains that temperature for 30 minutes. Then it cools the plurality of filaments 36 to 355° C. and maintains that temperature for 30 minutes. As a result, the plurality of filaments 36 reaches a substantially soft solid state that facilitates further processing.

After being cooled to 355° C., the filaments 36 are passed to the sizing station 40. At the sizing station 40, a rayon sizing agent 42 is applied to the plurality of filaments 36. Specifically, the plurality of filaments 36 is coated with the rayon agent 42 to form a plurality of fibers 44. The rayon agent 42 is preferably in yarn form and is provided in an amount such that rayon forms 2 wt. % of the resulting fibers 44. As a result of the rayon coating, the fibers 44 are protected from mechanical damage and formation of yarn from the fibers 44 is facilitated. Once they have been sized, the fibers 44 are collected and processed by the twisting device 46. Specifically, the twisting device 46 drafts and twists the plurality of fibers 44 to form the inorganic yarn 16. Preferably, the resulting inorganic yarn 16 has a diameter in a range of ten to fifteen millimeters.

For the present invention, a yarn 16 manufactured according to the above method is preferably comprised of about 40 wt. % calcium oxide, 36.6 wt. % magnesium oxide, 8.4 wt. % potassium oxide, 0.8 wt. % aluminum oxide, 0.85 wt. % iron oxide, 0.85 wt. % silicon dioxide, 0.8 wt. % titanium dioxide, 0.8 wt. % sodium oxide, 0.6 wt. % boron, 8 wt. % iron oxide, and 2 wt. % rayon. Such a yarn 16 has a melting point in the range between approximately 1500° C. and approximately 1650° C. and has a working range of about −130° C. to 700° C. Further, the yarn is relatively very light, with a density of about one and six tenths grams per cubic centimeter (1.6 g/cc).

Figure 3:
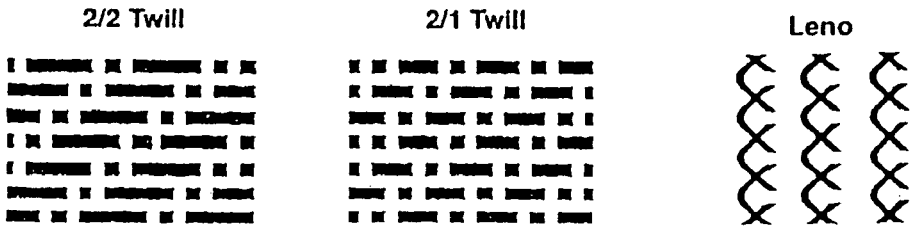
FIG. 3 is a diagrammatic depiction of several exemplary weave styles which may be employed in the fabric in accordance with the present invention.

While FIG. 1 depicts a representative weave comprising the inorganic yarn 16, it will be understood that any number of weaves may be utilized in forming the inventive fabric 10. Several exemplary weaves, all well known in the pertinent art, are shown in FIG. 3. Specifically, FIG. 3 includes depictions of a plain weave, crowfoot satin weave, 2×2 basket weave, 2/2 twill weave, 2/1 twill weave, and leno weave. For the present invention, such weaves may be selected, designed or utilized to control the weight, thickness, density, and strength of the fabric 10. Further, specific weaves may be desired for specific applications of the fabric 10.

While the particular fabric as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A fabric formed from yarn comprised of inorganic filaments coated with rayon, with the inorganic filaments being formed from volcanic black rock.

2. A fabric as recited in claim 1 wherein the inorganic filaments are spun from a melt of the volcanic black rock.

3. A fabric as recited in claim 1 wherein the inorganic filaments are comprised of calcium oxide, magnesium oxide, potassium oxide, aluminum oxide, iron oxide, silicon dioxide, titanium dioxide, sodium oxide, and boron.

4. A fabric as recited in claim 3 wherein the yarn is comprised of approximately:

35–45 wt. % calcium oxide;
30–40 wt. % magnesium oxide;
5–10 wt. % potassium oxide;
less than 2 wt. % aluminum oxide;
5–10 wt. % iron oxide;
less than 2 wt. % silicon dioxide;
less than 2 wt. % titanium dioxide;
less than 2 wt. % sodium oxide;
less than 2 wt. % boron; and
1–5 wt. % rayon.

5. A fabric as recited in claim 1 wherein the yarn is approximately 98 wt. % filaments and 2 wt. % rayon.

6. A fabric as recited in claim 5 wherein the yarn is comprised of approximately:

40 wt. % calcium oxide;
36.6 wt. % magnesium oxide;
8.4 wt. % potassium oxide;
0.8 wt. % aluminum oxide;
8.85 wt. % iron oxide;
0.85 wt. % silicon dioxide;
0.8 wt. % titanium dioxide;
0.8 wt. % sodium oxide;
0.6 wt. % boron; and
2 wt. % rayon.

7. A fabric as recited in claim 1 wherein the fabric has a melting point between approximately fifteen hundred degrees Centigrade (1500° C.) and approximately sixteen hundred and fifty degrees Centigrade (1650° C.).

8. A fabric as recited in claim 1 wherein the fabric has a working range of approximately negative one hundred thirty degrees Centigrade (−130° C.) to approximately seven hundred degrees Centigrade (700° C.).

9. A fabric as recited in claim 1 wherein the fabric has a surface density between approximately one hundred and sixty grams per square meter (160 g/m$^2$) and approximately three hundred and fifty grams per square meter (350 g/m$^2$).

10. A fabric as recited in claim 1 wherein the fabric has a tensile strength between approximately five hundred pound-force per square inch (500 lbf/in$^2$) and approximately eighteen hundred pound-force per square inch (1800 lbf/in$^2$).

11. A fabric comprising a woven yarn manufactured by:

mixing a volcanic rock with an additive to prepare a raw material, wherein the additive includes potassium permanganate;

melting the raw material to create a melt;

spinning the melt to create a plurality of filaments having diameters substantially in a range between one and ten microns;

cooling the plurality of filaments;

sizing the plurality of filaments with a rayon agent to create fibers;

twisting the plurality of fibers to make the yarn; and weaving the yarn into the fabric.

12. A fabric as recited in claim 11 wherein the volcanic rock is black rock and the raw material includes approximately one hundred parts of black rock and approximately fourteen parts of additive.

13. A fabric as recited in claim 11 wherein the additive further includes iron oxide, crushed whitestone, and boron.

14. A fabric as recited in claim 11 wherein the potassium permanganate fuels the melting step.

15. A fabric as recited in claim 11 wherein the fabric has a melting point between approximately 1500° C. and approximately 1650° C.

16. A fabric as recited in claim 11 wherein the fabric has a working range of approximately negative one hundred thirty degrees Centigrade (−130° C.) to approximately seven hundred degrees Centigrade (700° C.).

17. A fabric as recited in claim 11 wherein the fabric has a surface density between approximately one hundred and sixty grams per square meter (160 g/m$^2$) and approximately three hundred and fifty grams per square meter (350 g/m$^2$).

18. A fabric as recited in claim 11 wherein the fabric has a tensile strength between approximately five hundred pound-force per square inch (500 lbf/in$^2$) and approximately eighteen hundred pound-force per square inch (1800 lbf/in$^2$).

19. A fabric comprising a weave of yarn consisting of inorganic filaments coated with rayon, with the inorganic filaments being formed from volcanic black rock.

20. A fabric as recited in claim 19 wherein the inorganic filaments are spun from a melt of the volcanic black rock and are comprised of calcium oxide, magnesium oxide, potassium oxide, aluminum oxide, iron oxide, silicon dioxide, titanium dioxide, sodium oxide, and boron.

* * * * *